United States Patent [19]

Takagi et al.

[11] Patent Number: 5,073,055

[45] Date of Patent: Dec. 17, 1991

[54] SHEET-FEED/SHEET-RECEIVING UNIT USED IN COMBINATION WITH PRINTER

[75] Inventors: Kazuhiko Takagi, Nagoya; Rikuo Sonoda, Aichi, both of Japan

[73] Assignee: Brother Kogyo Kabushiki Kaisha, Japan

[21] Appl. No.: 434,289

[22] Filed: Nov. 13, 1989

[30] Foreign Application Priority Data

| | | | |
|---|---|---|---|
| Nov. 11, 1988 | [JP] | Japan | 63-286547 |
| Dec. 16, 1988 | [JP] | Japan | 63-318908 |
| Feb. 13, 1989 | [JP] | Japan | 1-34632 |

[51] Int. Cl.[5] ..... B41J 13/00; B41J 15/00

[52] U.S. Cl. ..... 400/578; 400/624; 400/629; 400/647.1; 400/692; 400/611

[58] Field of Search ..... 400/646, 647, 647.1, 400/625, 624, 605, 607, 607.2, 578, 629, 692, 607.1, 611; 271/9, 292–294, 207

[56] References Cited

U.S. PATENT DOCUMENTS

| | | | |
|---|---|---|---|
| 4,540,297 | 9/1985 | Imaizumi | 400/605 |
| 4,564,187 | 1/1986 | Costa et al. | 271/9 |
| 4,565,360 | 1/1986 | Runzi | 271/4 |
| 4,619,338 | 10/1986 | Ono et al. | 400/578 |
| 4,688,957 | 8/1987 | Prevignano | 400/605 |

FOREIGN PATENT DOCUMENTS

| | | | |
|---|---|---|---|
| 0227116 | 8/1986 | European Pat. Off. . | |
| 0142472 | 12/1987 | European Pat. Off. . | |
| 0258026 | 3/1988 | European Pat. Off. . | |
| 3712114 | 10/1987 | Fed. Rep. of Germany | 400/692 |
| 58-95065 | 6/1983 | Japan . | |
| 13584 | 1/1985 | Japan | 400/625 |
| 60-13585 | 1/1985 | Japan . | |

*Primary Examiner*—Edgar S. Burr
*Assistant Examiner*—Joseph R. Keating
*Attorney, Agent, or Firm*—Oliff & Berridge

[57] ABSTRACT

In a printer of the type having a print mechanism comprising a platen rotatable about its own axis for supporting a print sheet, an ink ribbon cassette accommodating an ink ribbon therein, and a print head movable along the platen for performing a print operation on the print sheet with the use of the ink ribbon, a hopper storing a stack of cut sheets is disposed above a first area of a printer frame and a stacker above a second area thereof. A pin tractor is disposed beneath the first area thereof for mounting a continuous sheet. The cut sheet and the continuous sheet are selectively fed to the print mechanism for printing. The stacker is movably disposed between a cut sheet receiving position allowing to receive the cut sheets discharged from the platen and a rest position rejecting to receive the cut sheet. A space above the second area is enlarged when the stacker is brought to the rest position, whereby the ink ribbon cassette disposed beneath the second area can easily be exchanged. When the continuous sheet is used, the stacker is brought to the rest position allowing to receive the continuous sheet from the platen. A sheet feed direction switching unit is detachably coupled to the stacker for selectively discharging the printed cut sheet onto a sub-stacker face up or onto the stacker face down.

39 Claims, 15 Drawing Sheets

SHEET-FEED/SHEET-RECEIVING UNIT USED IN COMBINATION WITH PRINTER

BACKGROUND OF THE INVENTION

The present invention relates to a sheet-feed/sheet-receiving unit used in combination with a printer. More particularly, the invention relates to an arrangement of a hopper and a stacker mounted on the printer.

In a printer of the type having a print mechanism comprising a platen for supporting a print sheet, an ink ribbon cassette accommodating an ink ribbon therein, and a print head for performing a printing operation on the print sheet with the use of the ink ribbon, a hopper and a stacker are typically detachably mounted for feeding the print sheet and receiving the same. Specifically, in the hopper, a stack of cut sheets are retained and the uppermost sheet is fed into a gap between the print head and the platen, and after the printing is carried out by the print head the sheet is discharged onto the stacker. The hopper is typically disposed above the rear portion of the print mechanism and the stacker is disposed above the front portion of the print mechanism. With such an arrangement, since the upper portion of the ribbon cassette is covered with the stacker, the ribbon cassette is prevented from being exchanged. To expose the upper portion of the cassette for allowing to exchange the cassette, the stacker has to be removed from the printer. In actuality, however, not only the stacker but also the hopper has to be removed therefrom, since the stacker and the hopper are fixedly coupled to each other.

A pin tractor may further be detachably mounted on the printer so that a continuous sheet entrained by the pin tractor can be selectively used, which is typically mounted on the rear portion of the print mechanism and is covered with the hopper. Besides, the stacker exists in the portion where the printed continuous sheet is discharged from the printer, so it has been difficult to use the pin tractor if the hopper and the stacker are mounted on the printer. When it is intended to use the continuous sheet, the hopper and the stacker have to be removed.

Further, when it is intended to use the cut sheet, the operator may want to discharge the printed sheet on the stacker either face down or face up. Japanese Laid-Open Patent Publication No. 58-95065 discloses an arrangement to this effect, in which a change-over lever having opposing sheet guide surfaces is disposed on a sheet discharge path, and the stacker is movably disposed either of the sides in the discharge path. By the actuation of the lever, the printed sheet is guided by either one surface of the lever and discharged onto the stacker either face up or face down. However, the position of the change-over lever prevents visual recognition of the printing operation.

SUMMARY OF THE INVENTION

The present invention has been made to eliminate the above-described disadvantages accompanying the conventional printers, and accordingly it is an object of this invention to provide a sheet-feed/sheet-receiving unit used in combination with a printer, in which the exchange of an ink ribbon cassette is facilitated without need for removing the unit.

It is another object of the invention to provide a sheet-feed/sheet-receiving unit used in combination with a printer, in which a continuous sheet can be used without removing the unit from the printer.

It is still another object of the invention to provide a sheet-feed/sheet-receiving unit used in combination with a printer, in which when cut sheets are used, the printed sheets can be discharged either face up or face down whichever is desired.

In order to achieve the above and other objects, there is provided a sheet-feed/sheet-receiving unit for use in combination with a printer having a print mechanism comprising a platen rotatable about its own axis for supporting a print sheet, an ink ribbon cassette accommodating an ink ribbon therein, and a print head movable along the platen for performing a print operation on the print sheet with the use of the ink ribbon, the printer being housed in a housing defined by a printer frame, the unit comprising a hopper frame disposed above a first area of the printer frame, the hopper frame being adapted to receive a hopper storing a stack of cut sheets therein and having feedout means for feeding an uppermost cut sheet toward the platen, and a stacker disposed above a second area of the printer frame, the stacker being rotatably coupled to the hopper frame about an axis substantially parallel to the axis of the platen and being movable between a cut sheet receiving position allowing to receive the cut sheets discharged from the platen and a rest position, a space above the second area being enlarged when the stacker is brought to the rest position, whereby the ink ribbon cassette can easily be exchanged. A pin tractor is disposed beneath the first area of the printer frame for mounting a continuous sheet, the continuous sheet being entrained by the pin tractor and fed toward the platen. The hopper frame is movably disposed between a cut sheet feeding position capable of feeding the uppermost sheet toward the platen and a rest position. A space above the first position is enlarged when the hopper is brought to the rest position.

According to another aspect of the invention, there is provided a sheet-feed/sheet-receiving unit for use in combination with a printer having a print mechanism comprising a platen rotatable about its own axis, an ink ribbon cassette accommodating an ink ribbon therein, and a print head movable along the platen for selectively printing on a cut sheet and a continuous sheet with the use of the ink ribbon, the printer being housed in a housing defined by a printer frame, the unit comprising a hopper frame disposed above a first area of the printer frame, the hopper frame being adapted to receive a hopper storing a stack of cut sheets therein and having feedout means for feeding an uppermost cut sheet toward the platen, a pin tractor disposed beneath the first area of the printer frame for mounting the continuous sheet, the continuous sheet being entrained by the pin tractor and fed toward the platen, and a stacker disposed above a second area of the printer frame, the stacker being rotatably coupled to the hopper frame about an axis substantially parallel to the axis of the platen and being movable between a cut sheet receiving position allowing to receive the cut sheets discharged from the platen and a rest position, the stacker having a supporting member for supporting the cut sheets delivered from the platen, and a sheet guide member, wherein when the stacker is brought to the cut sheet receiving position, a cut sheet passageway is formed between the supporting member and the guide member for guiding the cut sheets discharged from the platen, and when the stacker is brought to the rest position, a continuous sheet passageway is formed between the guide member and the hopper frame for guiding the continuous sheet discharged from the platen. A delivery roller is further included for delivering the cut sheet discharged from the platen to the stacker. A sub-stacker is provided for receiving the cut sheet discharged from the platen. A sheet feed direction switching unit is detachably coupled to the stacker for switching a direction in which the cut sheet delivered from the delivery roller is fed between a first direction and a second direction, wherein in the cut sheet delivered by the delivery roller is discharged onto the stacker face down when the first direction is selected by the switching unit and the cut sheet delivered by the delivery roller is discharged onto the sub-stacker face up when the second direction is selected by the switching unit. The switching unit is rotatable about another axis substantially parallel to the axis of the platen and movable between a cut sheet receiving position allowing to receive and deliver the cut sheet toward either of the first and second directions and a reject position prohibiting to receive the cut sheet, the switching unit being brought to the reject position when the stacker is moved to the rest position.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

In the following description, the expression "front", "rear", "above" and "below" are used to define the various parts when the printer is disposed in an orientation in which it is intended to be used.

Figure 1:
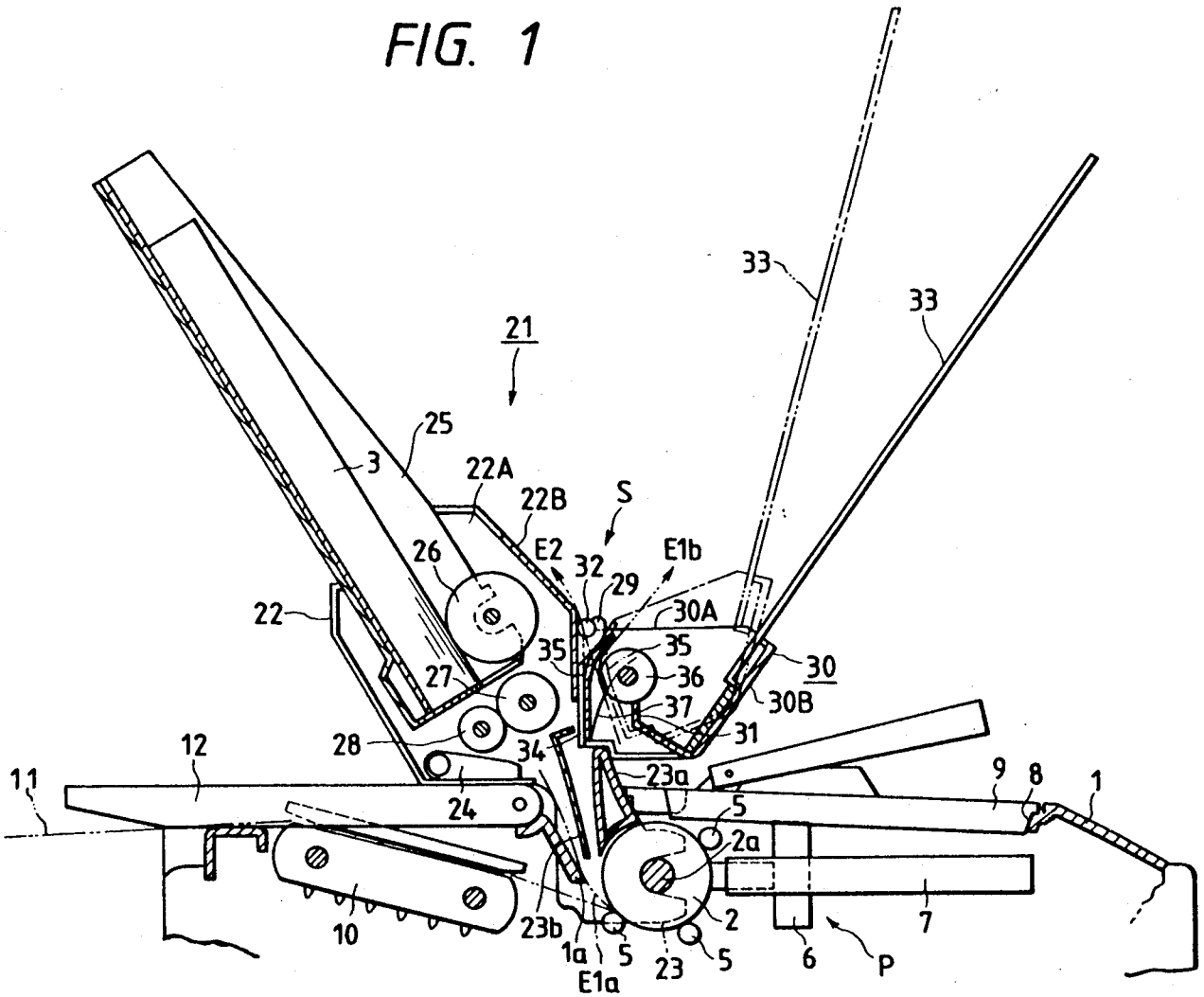
FIG. 1 is a vertical cross-sectional view showing a sheet-feed/sheet-receiving unit mounted on a printer according to the present invention.

FIG. 1 shows a sheet-feed/sheet-receiving unit 21 for use in combination with a printer. The printer has a print mechanism P comprising a platen 2 rotatable about its own axis for supporting a print sheet, an ink ribbon cassette 7 accommodating an ink ribbon therein, and a print head 6 movable along the platen for performing a print operation on the print sheet with the use of the ink ribbon. The printer is housed in a housing defined by a printer frame.

More specifically, the platen 2 is rotatably supported by the printer frame 1. A plurality of paper locking rollers 5 are disposed in the outer periphery of the platen 2 to be rotatable together with the platen 2. A carriage (not shown) is movably provided in association with the platen 2 to be movable along the longitudinal direction of the platen 2. The print head 6 is mounted on the carriage and the ink ribbon cassette 7 is detachably mounted thereon. An opening 8 is formed in the front portion of the printer frame 1 for allowing the ribbon cassette 7 to be loaded on or removed from the carriage. A cover 9 is detachably provided in the opening 8.

Figure 2:
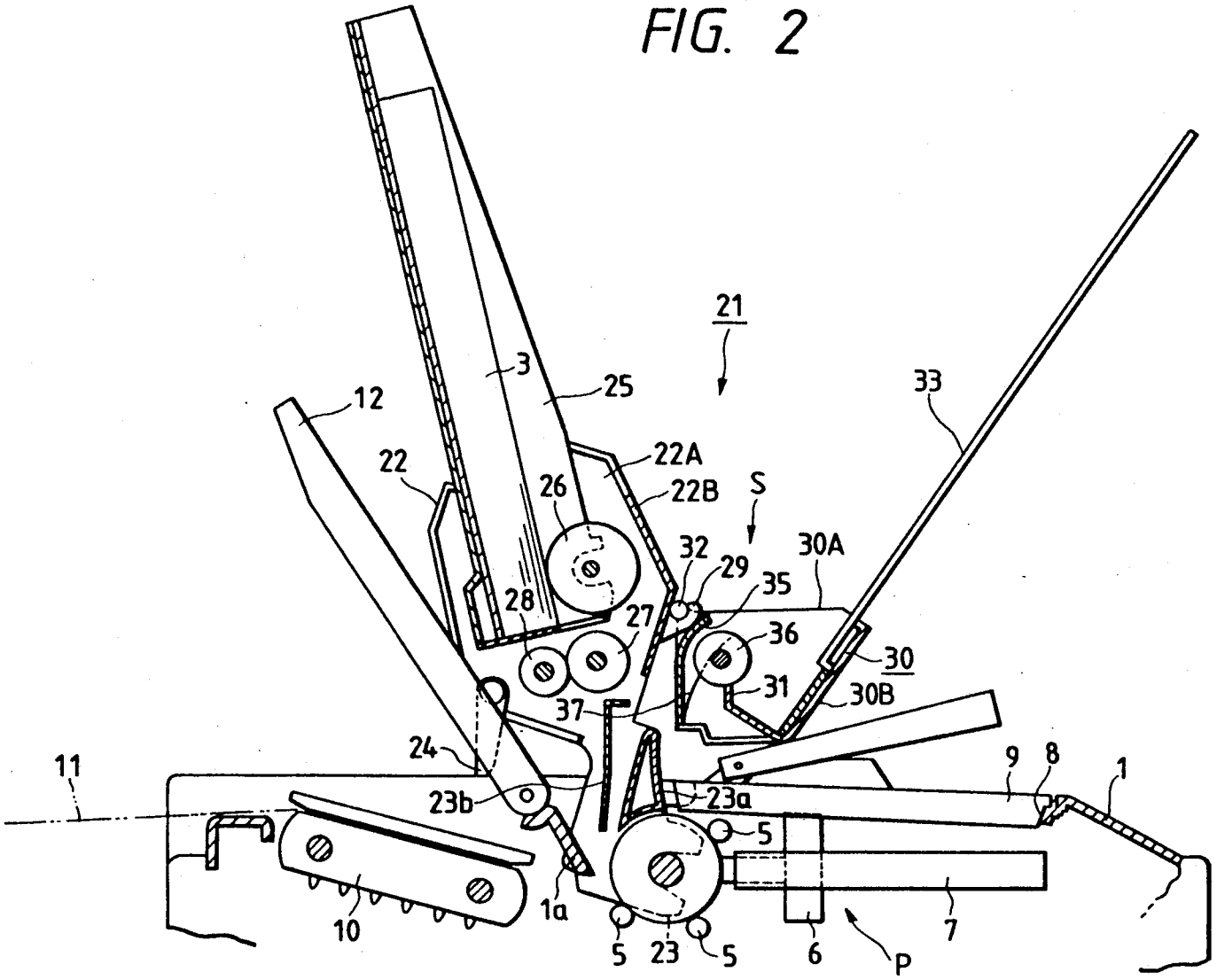
FIG. 2 is a vertical cross-sectional view showing a state of the sheet-feed/sheet-receiving unit when a continuous sheet is used for printing.

In the rear portion of the print mechanism P, a pin tractor 10 is disposed internally of the printer housing to be movable in synchronism with the rotations of the platen 2. A continuous sheet 11 provided with uniformly-spaced perforations is drivingly engaged by the pin tractor 10 to move the sheet 11 incrementally past the print mechanism P. In the print mechanism, the sheet 11 is fed into a gap between the platen 2 and each of the paper locking rollers, thereby transferring and retaining the sheet 11 onto the platen 2. Above the pin tractor 10, a tractor cover 12 is hinged to the printer frame 1 to be rotatable about a fulcrum at the frontmost end of the cover 12, which may be closed as shown in FIG. 1 and opened as shown in FIG. 2.

In accordance with the rotations of the platen 2 and the paper locking rollers 5, a cut sheet 3 or the continuous sheet 11 is brought to a print position confronting the print head 6. The print head 6 performs printing on the sheet 3 or 11 through the ink ribbon as it is moved along the platen 2.

Above the print mechanism P, the sheet-feed/sheet-receiving unit 21 is detachably provided on the printer frame 1. The unit 21 includes a hopper frame 22 and a stacker 30. The hopper frame 22 is disposed above the rear portion of the printer frame 1. The hopper frame 22 is adapted to receive a hopper storing a stack of cut sheets 3 therein. A feedout roller 26 is provided for feeding the uppermost cut sheet toward the platen 2. The stacker 30 is disposed above the front portion of the printer frame 1. The stacker 30 is rotatably coupled to the hopper frame 22 about an axis substantially parallel to the axis of the platen 2. The stacker 30 is movable between a cut sheet receiving position allowing to receive the cut sheets discharged from the platen and a rest position.

Specifically, the hopper frame 22 is made up of a pair of side frames 22A and a front wall 22B bridging between the side frames 22A. A pair of connection arms 23 (only a counterpart thereof is depicted in FIG. 1) project from the side frames 22A to be engageable with the shaft 2*a* of the platen 2 at both ends thereof. Thus, the hopper frame 22 is rotatably connected to the printer frame 1. A pair of sheet guides 23*a*, 23*b* are provided in spaced apart relation with each other between the connection arms 23.

In the lower portion of the side frame 22A, arms 24 are pivotally secured, which are normally retracted inside the side frame 22A as shown in FIG. 1 or projects outwardly of the side frame 22A as shown in FIG. 2. When the arms 24 are retracted, the bottom portions of the side frames 22A are in contact with the upper surface of the printer frame 1 and the hopper frame 22 is retained in a cut sheet feeding position capable of feeding the uppermost sheet toward the platen. When the continuous sheet 11 is to be loaded on the pin tractor 10, the hopper frame 22 is rotated in clockwise direction about the shaft 2*a* of the platen 2 and is brought to a rest position as shown in FIG. 2. When the hopper frame 22 is in the rest position, a space above the tractor cover 12 is enlarged, and the continuous sheet can be mounted on the pin tractor 10 by opening the tractor cover 12.

A pair of feed rollers 27, 28 are rotatably supported by the side frame 22A. When the hopper frame 22 is in the cut sheet feeding position as shown in FIG. 1, the feed rollers 27, 28 are disposed on a line extending from a cut sheet path Ela defined by one guide wall of the sheet guide 23*b* and a sheet guide 23*b*. A pair of bearing pieces 29 (only a counterpart thereof is depicted in FIG. 1) project from the front wall 22B at its side edges. The cross-section of the bearing piece 29 is of an arcuate shape.

The stacker 30 has openings in its upper and bottom plates and is of an elongated box shape oriented in a direction parallel to the platen 2. In the lower portion of the stacker 30, there is provided a support portion 31 for supporting the cut sheets 3 discharged from the platen 2. A pair of rod pieces 32 are secured to the stacker 30 at its side edges and are engageable with the bearing pieces 29. With the engagement of the rod pieces with the bearing pieces 29, the stacker 30 is rotatably coupled to the printer frame 22. The stacker 30 is movable between a cut sheet receiving position indicated by a solid line in FIG. 1 and a rest position shown in FIG. 3. By a retaining means (to be described later) disposed between the printer frame 22 and the stacker 30, the stacker 30 is retained in the cut sheet receiving position, the rest position, and a continuous sheet receiving position indicated by two-dotted line in FIG. 1.

A sheet tray 33 is secured to the support portion 31 to be obliquely oriented with respect to the printer frame 1 for receiving the cut sheet 31 face down. The rear wall of the stacker 30 serves as a guide wall 35 which together with the front wall 22B of the hopper frame 22 defines a sheet path for the sheet manually inserted. Within the stacker 30, a delivery roller 36 is provided for feeding the cut sheet 3 toward the sheet tray 33 along a path Elb. A flexible film 37 is provided adjacent the delivery roller 36 for urging the cut sheet 3 toward the outer periphery of the delivery roller 36.

Figure 9:
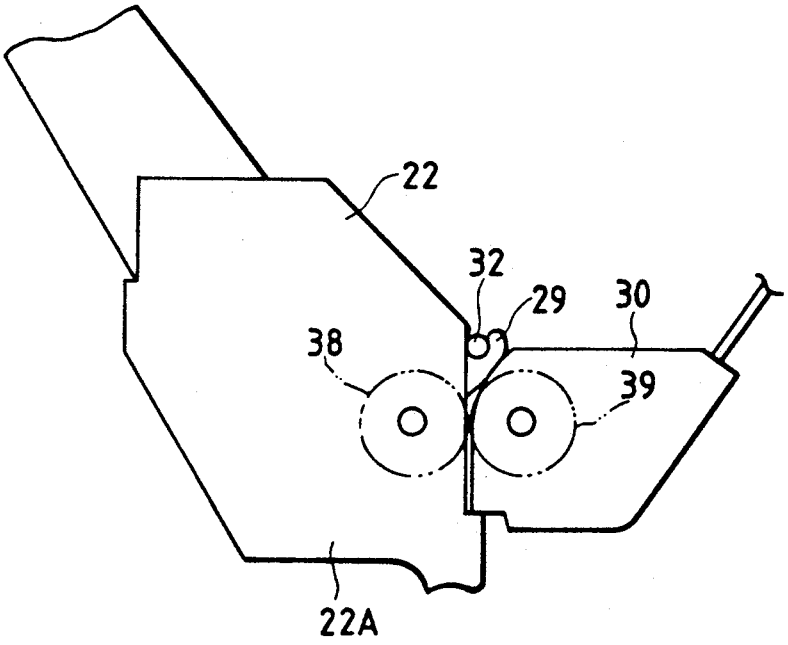
FIG. 9 is a vertical cross-sectional view partially showing a power transmission mechanism.

As shown in FIG. 9, a gear 38 is rotatably secured to the side frame 22A in such a manner that an outer periphery of the gear 38 partly projects from the front facet of the side frame 22A. The gear 38 is rotated by a motor (not shown) to interlock with the rotations of the feedout roller 26 and the feed rollers 27, 28. Further, a gear 39 is rotatably secured to the stacker 30 and is operably coupled to the delivery roller 36. The outer periphery of the gear 39 also projects partly from the rear wall of the stacker 30. When the stacker 30 is in the cut sheet receiving position indicated by the solid line in FIG. 1, the gears 38, 39 are in meshing engagement with each other, thereby rotating the delivery roller 36. On the other hand, when the stacker 30 is in the position indicated by the two-dotted line and in the rest position shown in FIG. 3, the gears are disengaged from each other.

To print on the cut sheet 3 with the printer thus constructed, the hopper frame 22 is disposed in a position shown in FIG. 1 and the stacker is disposed in the cut sheet receiving position indicated by the solid line in FIG. 1. In this condition, the bottom portion of the stacker 30 is in engagement with the sheet guide 23*a*, thereby retaining the stacker 30 in the cut sheet receiving position, and the feed rollers 27, 28 are disposed on a line extending from the cut sheet path Ela. Further, the bottom opening of the stacker 30 has been brought to a position confronting the sheet discharge side of the platen 2.

In accordance with the rotations of the feedout roller 26 and the feed rollers 27, 28, the uppermost cut sheet 3 stacked in the hopper 25 is fed toward the platen along the sheet path Ela defined by the guides 23*b* and 1*a*. The sheet printed with the print mechanism P is conveyed toward the stacker 30 in accordance with the rotations of the platen 2. The sheet passes through the path Elb defined by the guide wall 35 and the outer surface of the support portion 31. The sheet is urged onto the outer periphery of the delivery roller 36 by the flexible film 37. The sheet is then received on the support portion 31 and laid down on the sheet tray 33 of the stacker 30.

When the hopper frame 22 and the stacker 30 are positioned as described above, a cut sheet can be manually inserted into a sheet path 34 defined by the front wall 22B of the hopper frame 22 and the outer surface of the guide wall 35 of the stacker 30. When the sheet is manually inserted, the motor and a power transmission mechanism (not shown) are changed over not to rotate the feedout roller 26 but to rotate the delivery roller 36. The sheet inserted into the sheet path 34 passes through a path defined by the sheet guides 23*a*, 23*b* and is similarly discharged onto the stacker 30 in accordance with the rotations of the platen 2 upon printing.

On the other hand, when printing is effected on the continuous sheet 11, the hopper frame 22 is rotated about the shaft 2*a* of the platen 2 in clockwise direction from the state shown in FIG. 1, so that the bottom portion of the frame 2 is brought to a position separate from the upper surface of the printer frame 1. Then, the arms 24 project outwardly as shown in FIG. 2 due to the biasing force of a spring (not shown). By the abutment of the arms 24 with the upper surface of the printer frame 1, the frame 22 is retained in the position shown in FIG. 2, thereby enlarging the upper space of the tractor cover 12. At this time, the lower portion of the stacker 30 momentarily impinges the cover 9, however, the stacker 30 rotates about the rod pieces 32 and moves away from the cover 9 so that the cover 9 is not damaged.

Under the condition where the hopper frame 22 is lifted, the pin tractor 10 is exposed if the tractor cover 12 is opened as shown in FIG. 2, thereby allowing the continuous sheet 11 to be loaded on the pin tractor 10. Then, the cover 12 is closed and the arms 24 are retracted inside the hopper frame 22 by pushing the arms 24 from their rear sides, so that the hopper frame 22 is positioned in the state shown in FIG. 1. The stacker 30 is then rotated counterclockwise to retain it in the continuous sheet receiving position indicated by two-dotted line in FIG. 1 by means of the retaining means (to be described later). As a result, the space between the guide wall 35 of the stacker 30 and the front wall of the frame 22 is widened, and a continuous sheet path E2 is formed which is in communication with the platen discharging side. The sheet path E2 is defined by the front surface of the hopper frame 22 and the rear surface of the sheet guide 35.

Under this condition, the continuous sheet 11 is entrained by the pin tractor 10 and conveyed toward the platen 22. Printing is then effected on the continuous sheet 11 by the print mechanism P as the latter is actuated in synchronism with the driving of the pin tractor 10. After printing, the continuous sheet 11 is introduced into the path E2 in accordance with the rotations of the platen 2. The continuous sheet 11 is further conveyed to climb the inclined surface of the frame 22 and the leading edge of the sheet 11 reaches behind the frame 22. As such, the print mechanism P is not covered with the discharged continuous sheet 11 and thus the print position can be visually recognized.

In the foregoing embodiment, since the cut sheet path Ela and the continuous sheet path E2 are separately formed, the continuous sheet 11 is not introduced into the space between the flexible film 37 and the delivery roller 36. Therefore, the back feeding of the continuous sheet 11 can be smoothly performed, since the perforated score lines of the continuous sheet 11 are not captured by the flexible film 37.

Figure 3:
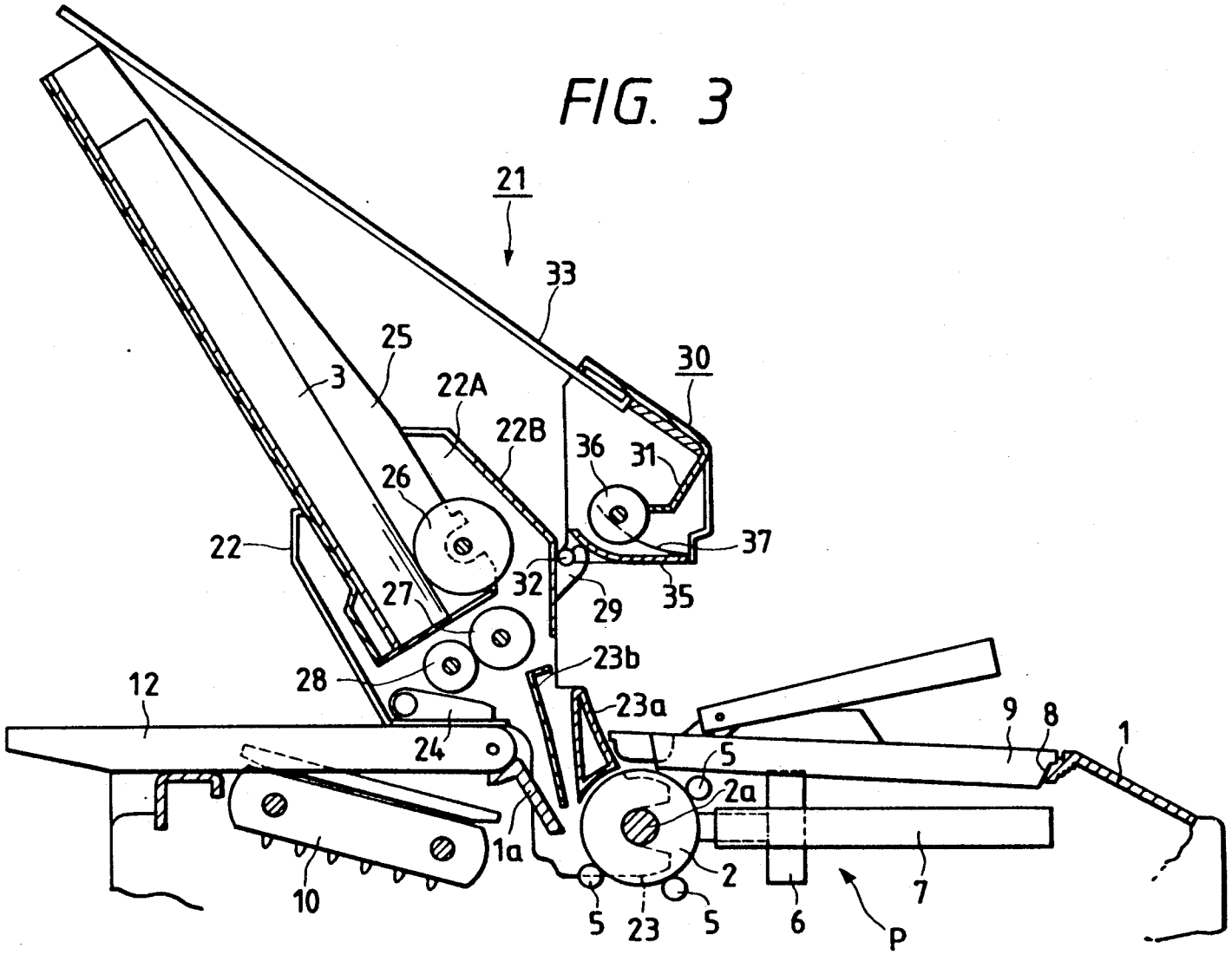
FIG. 3 is a vertical cross-sectional view showing a state of the sheet-feed/sheet-receiving unit when an ink ribbon cassette is exchanged.

When the ribbon cassette 7 is to be replaced with a new one, the stacker 30 may be rotated about the rod pieces 32 from the cut sheet receiving position shown in FIG. 1 to the rest position shown in FIG. 3, so that the stacker 30 is positioned apart from the print mechanism P and the upper space of the cover 9 is enlarged. In this condition, upon removing the cover 9 from the printer frame 1, the ribbon cassette 7 can readily be replaced with a new one. After the replacement of the ribbon cassette 7, the cover 9 may again be fitted to the printer frame 1 and the stacker 30 may be reversely rotated to place it in the original position.

With the printer as constructed above, intricate work such as removing the sheet-feed/sheet-receiving unit from the printer frame 1 is not necessary, and in addition, the replacement work of the ribbon cassette 7 can readily be performed.

Figure 4:
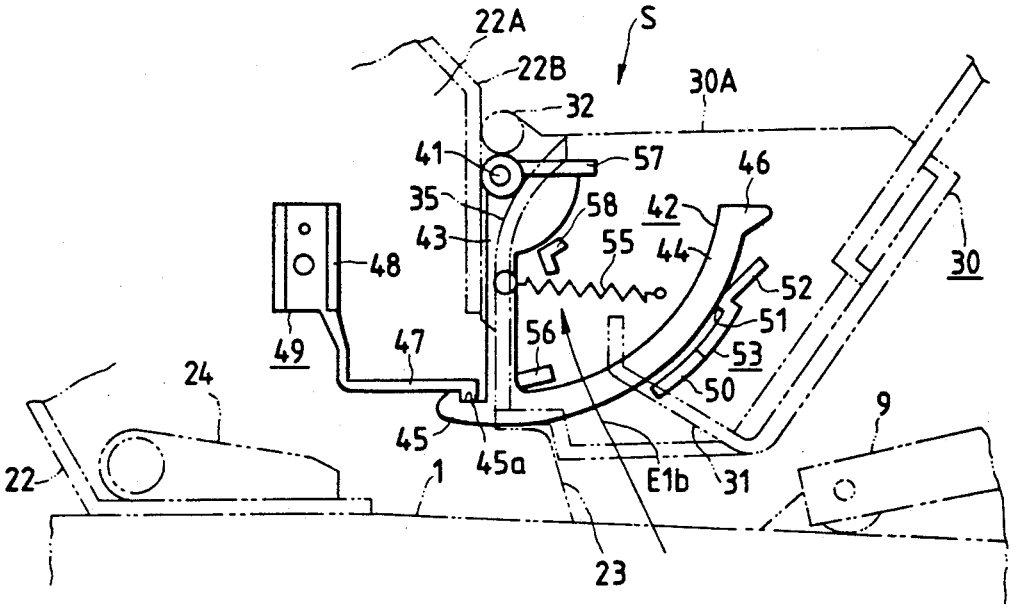
FIG. 4 is an enlarged vertical cross-sectional view partially showing the sheet-feed/sheet-receiving unit when it is placed for using the cut sheets.
Figure 5:
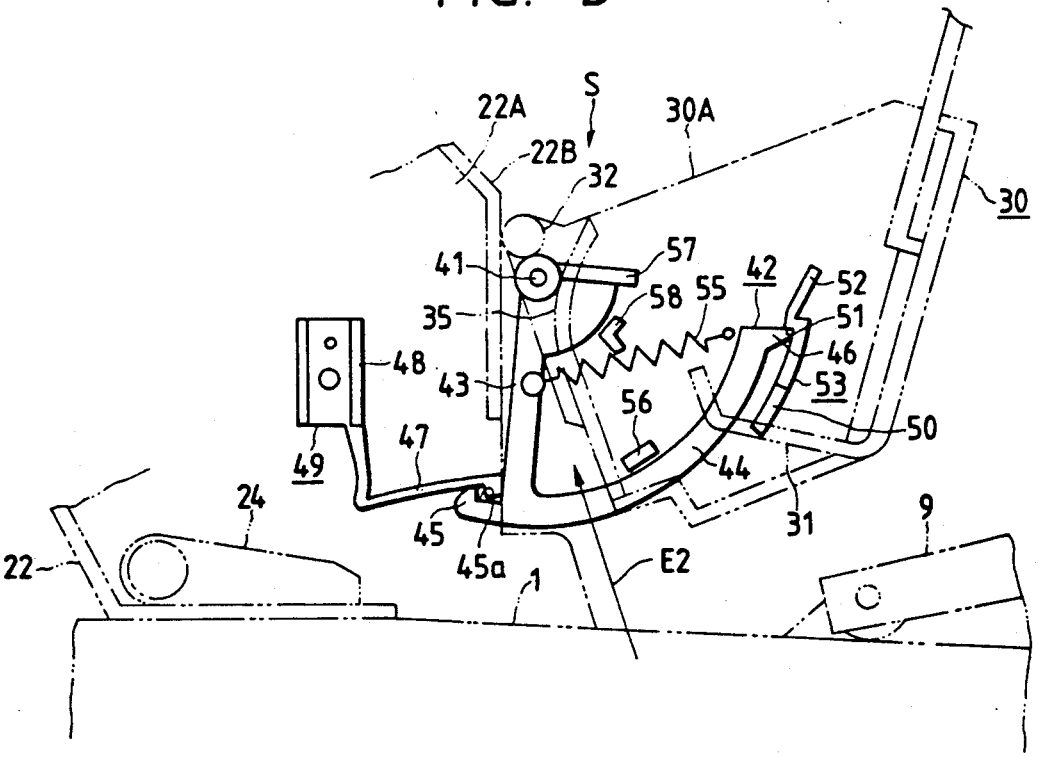
FIG. 5 is an enlarged vertical cross-sectional view partially showing the sheet-feed/sheet-receiving unit when it is placed for using the continuous sheet.

Referring to FIGS. 4 and 5, the retaining means will be described. On the side frames 30A of the stacker 30, a locking member 42 is rotatably supported about a shaft 41. The locking member 42 is made of a resilient synthetic resin and has an arcuate portion. A pair of protrusions 45, 46 are formed in the opposing edges of the arcuate portion, which project toward the hopper frame and the stacker. In the projection at the side of the hopper frame, a recess 45*a* is formed.

Figure 8:
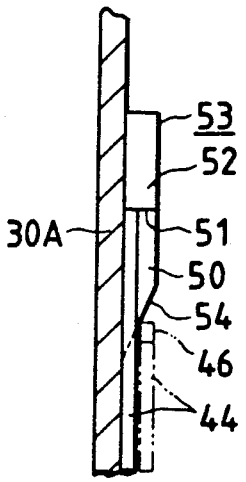
FIG. 8 is a partial cross-sectional view showing a locking member and a rib.

A locking assembly 49 made up of an L-shaped resilient locking member 47 and a base portion 48 is secured to the inner surfaces of the side frames of the hopper frame 22. The free end of the locking member 47 is engageable with the recess portion 45*a* of the protrusion 45. On the other hand, a rib 53 is upstanding on the inner surfaces of the side frames 30A of the stacker 30, which is made up of an arcuate portion 50 (whose curved surface is a segment of a circle depicted with respect to the shaft 41) and a stepped portion 51. As shown in FIG. 8, a half of the arcuated portion 50 in the free end side is inclined toward the inner surface of the side frame 30A, and a guide surface 54 is formed to be engageable with the protrusion 46 in the side of the stacker.

A spring 55 is provided between the locking member 42 and the side frame 30A for urging the locking member 42 toward the stacker. On the side frame 30A, a regulation piece 56 is formed which restricts the locking member 42 from being moved toward the stacker. Adjacent the shaft 41 of the base portion 43, an engagement piece 57 is formed which projects toward the stacker 30. An regulation piece 58 is formed on the side frame 30A which restricts the locking member 42 from being moved toward the hopper frame. Accordingly, the rotatable range of the locking member 42 is determined by the regulation pieces 56, 58.

The retaining means S is made up of the bearing piece 29, the rod piece 32, the locking member 42, the locking assembly 49 and the rib 53. Normally, the locking portion 44 is disposed in the side of the shaft 41 with respect to the rib 53.

In accordance with the movements of the hopper frame 22 and the stacker 30, the locking member 42 is changed over to the following states.

Figure 6:
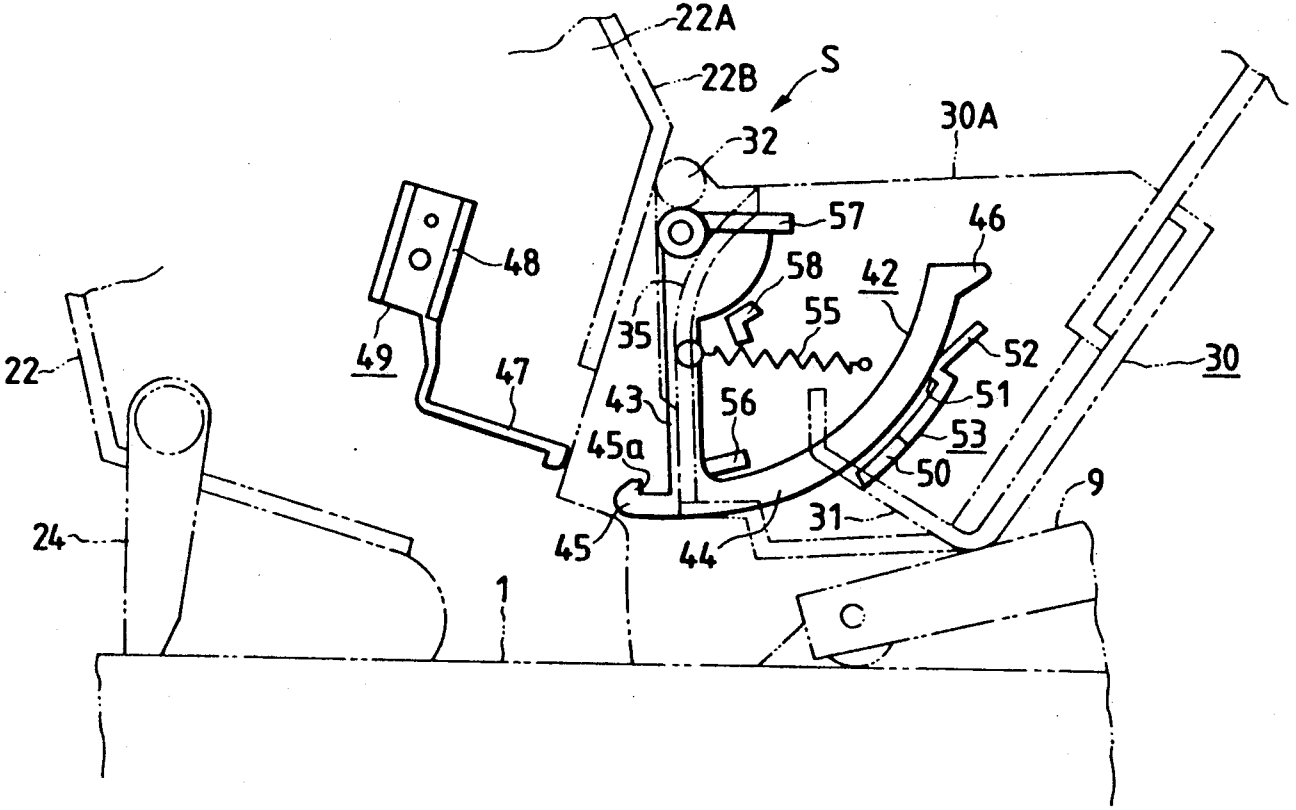
FIG. 6 is an enlarged vertical cross-sectional view partially showing the sheet-feed/sheet-receiving unit when it is placed for using the continuous sheet.
Figure 7:
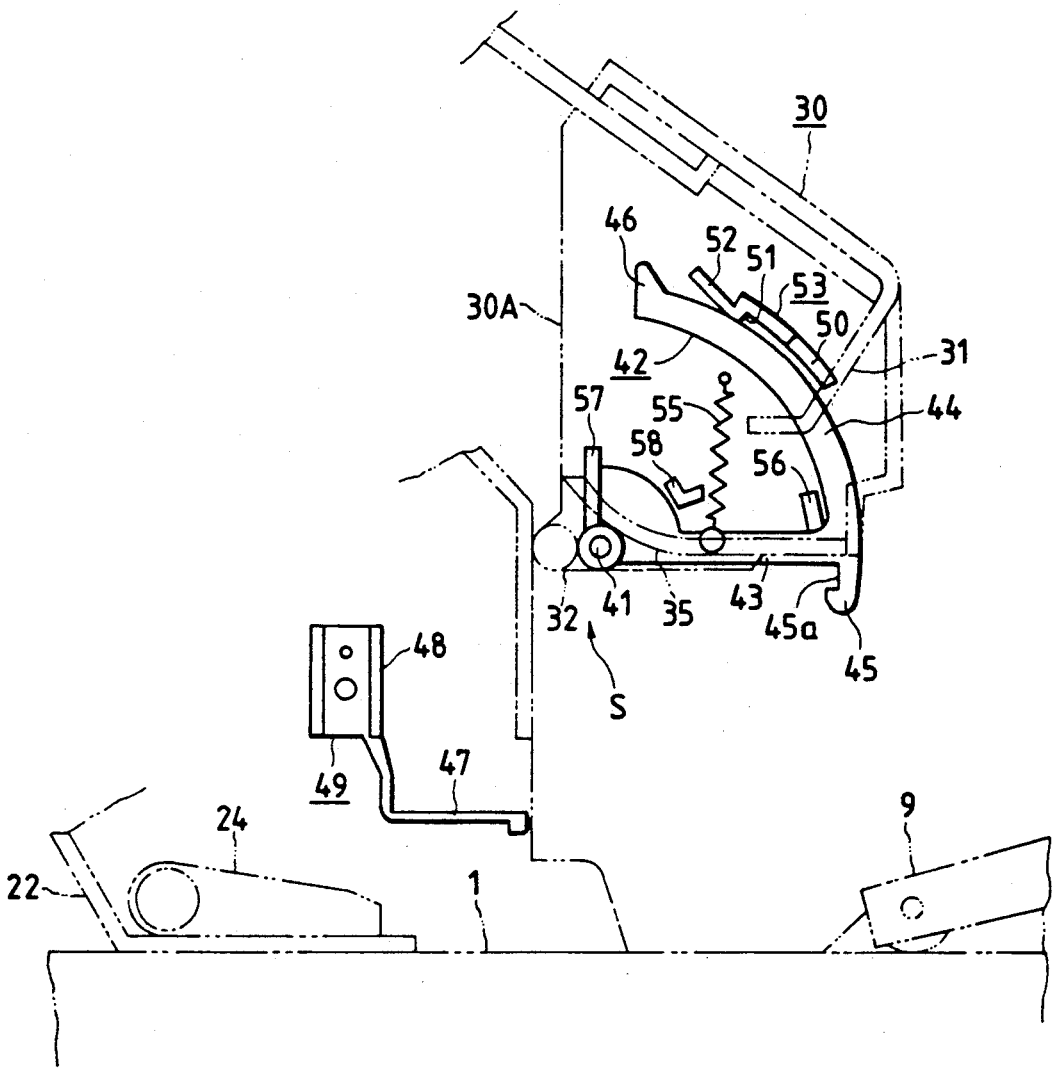
FIG. 7 is an enlarged vertical cross-sectional view partially showing the sheet-feed/sheet-receiving unit when the ink ribbon cassette is exchanged.

(1) As shown in FIG. 4, when the stacker 30 is arranged to the cut sheet receiving position, the recess portion 45*a* is brought into engagement with the locking member 47;

(2) As shown in FIG. 5, when the stacker is arranged to the continuous sheet receiving position, the recess portion 45*a* is brought into engagement with the locking member 47 and the protrusion 46 is brought into engagement with the stepped portion 51, to thereby retain the stacker in the position indicated in FIG. 5; and (3) As shown in FIGS. 6 and 7, when the continuous sheet is to be loaded on the pin tractor and the ink ribbon cassette is to be exchanged with a new one, the recess portion 45*a* is disengaged from the locking member 47 and a base arm 43 is brought in abutment with the regulation piece 56.

Figure 10:
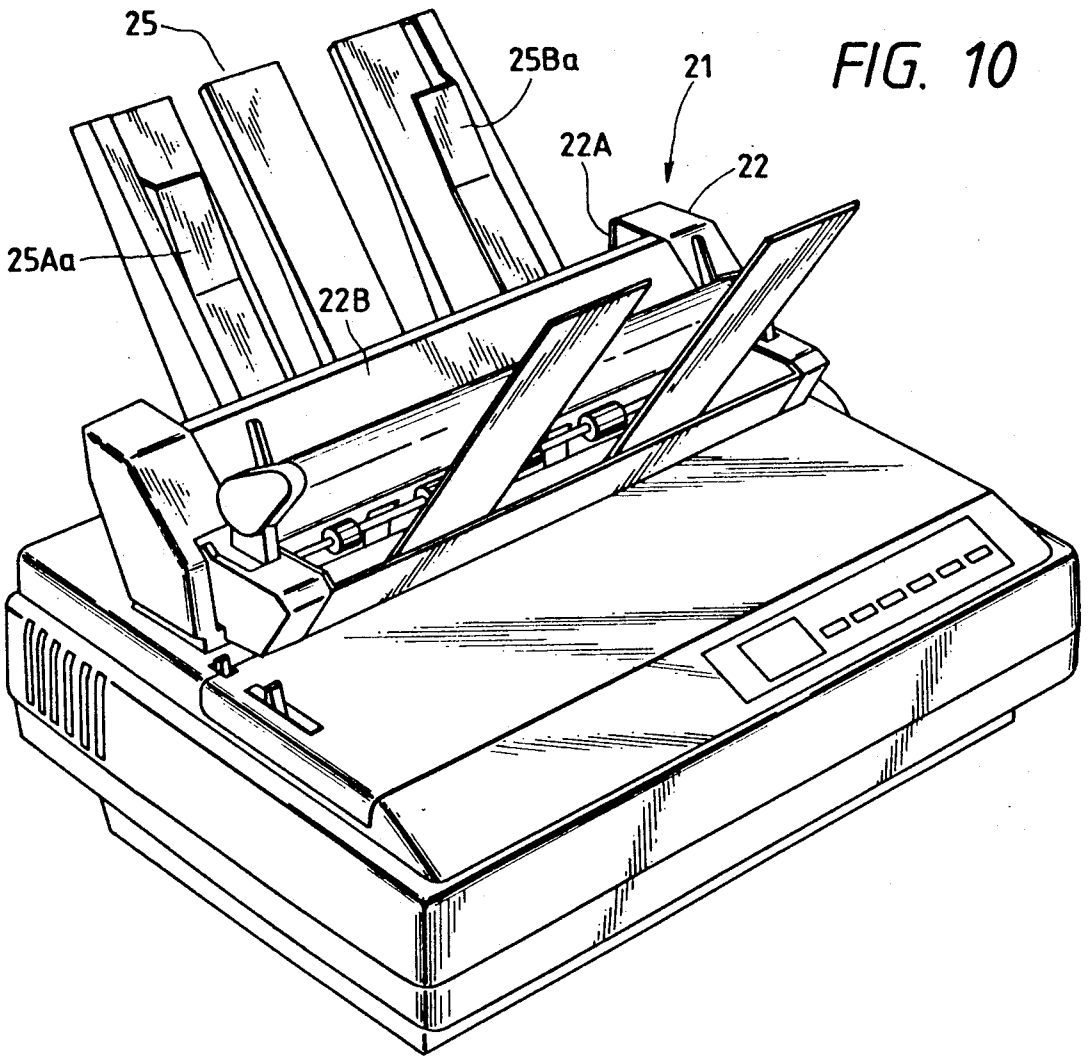
FIG. 10 is a perspective view showing a printer according to the present invention, on which a sheet feed direction switching unit is mounted.
Figure 11:
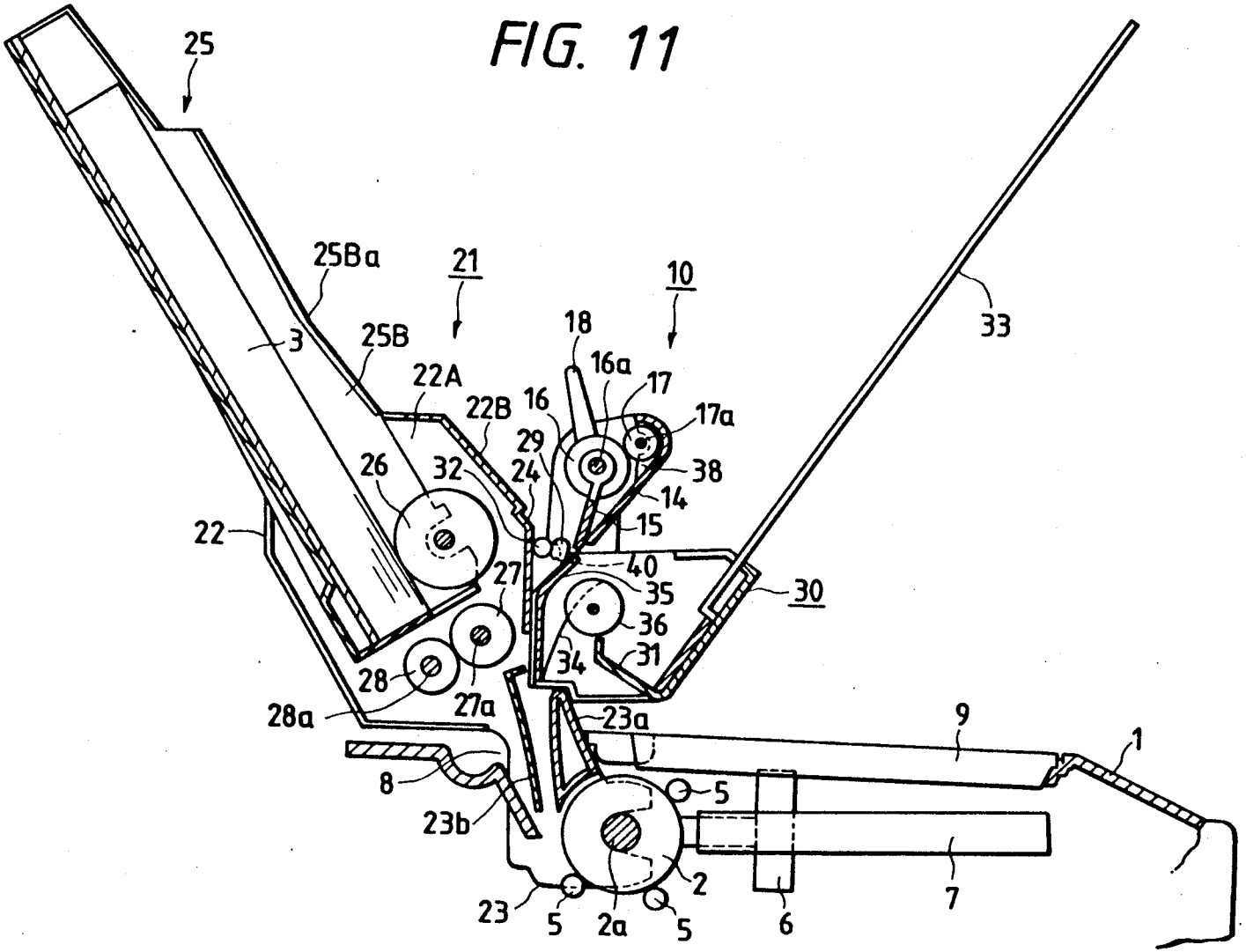
FIG. 11 is a vertical cross-sectional view showing a sheet-feed/sheet-receiving unit mounted on a printer.
Figure 14:
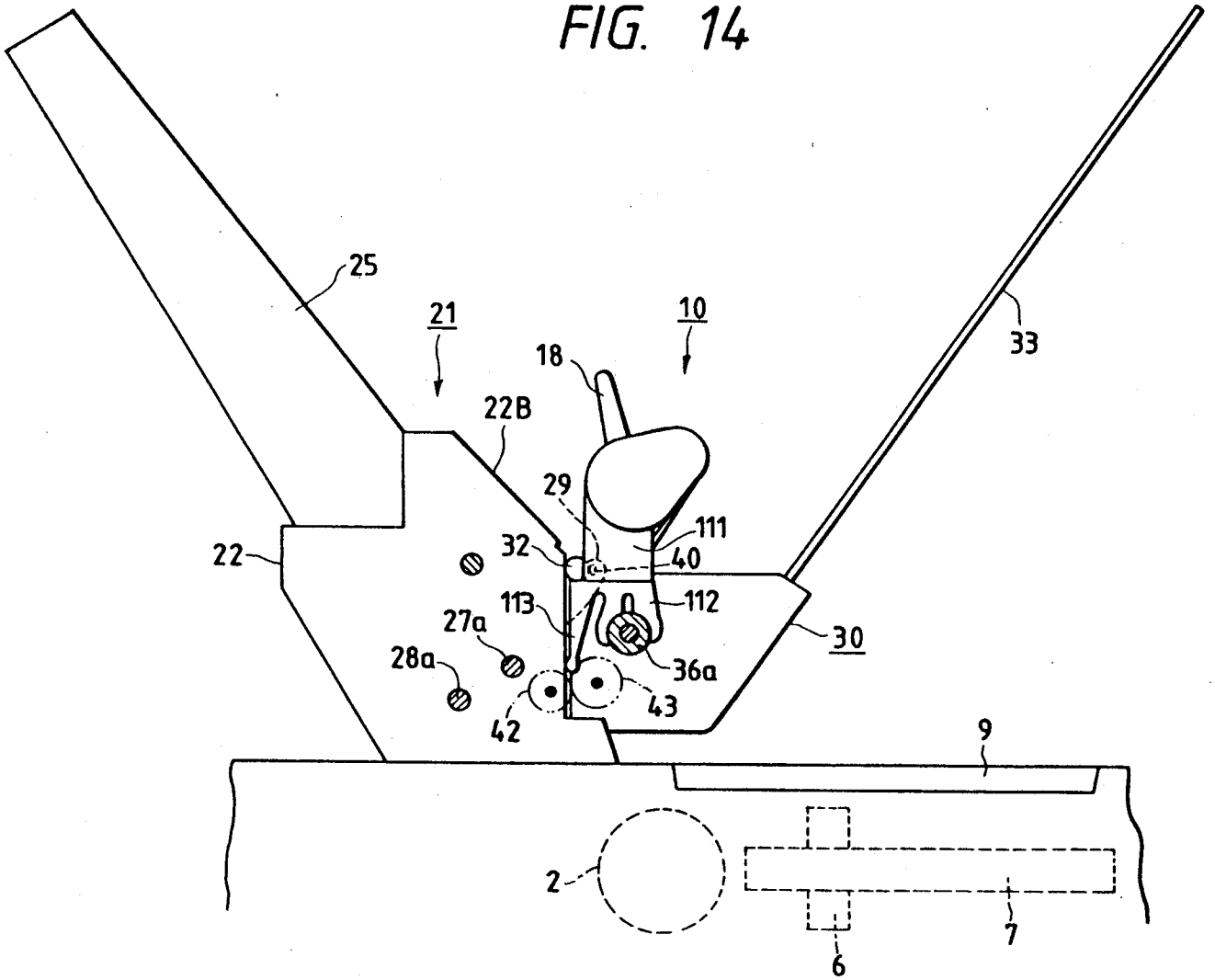
FIG. 14 is a vertical cross-sectional view showing the sheet feed direction switching unit when the stacker is disposed in the cut sheet receiving position.
Figure 15:
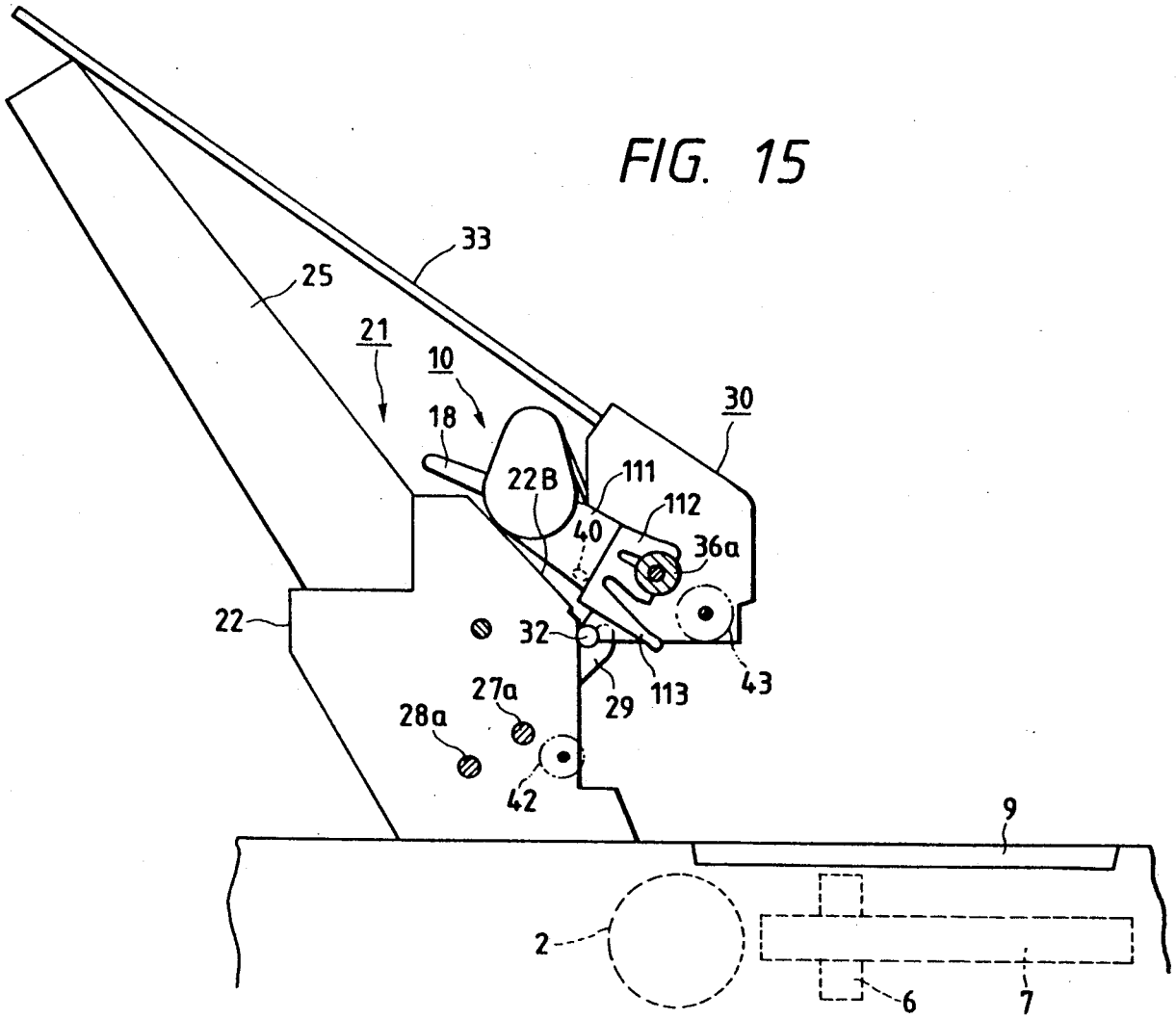
FIG. 15 is a vertical cross-sectional view showing the sheet feed direction switching unit when the stacker is disposed in the rest position.

Next, a sheet feed direction switching unit 10 will be described. FIG. 10 is a perspective view showing the printer to which the sheet feed direction switching unit 10 is mounted, and FIG. 11 is a vertical cross-section showing the switching unit 10. In FIGS. 10 and 11, reference numerals 25A*a* and 25B*a* denote plate members overlaid the hopper, which serves as a sub-stacker to receive the printed cut sheet face up. As shown in FIG. 14, the unit 10 has a pair of side supporting members 111 (only a counterpart thereof is depicted) made of a synthetic resin. In the lower portion of the side supporting member 111, there are provided leg portions 112 which grasp the shaft 36*a* of the delivery roller 36 so as to be rotatable thereabout due to its resiliency, and a resilient supporting piece 113 which restricts the clockwise rotations of the unit 10. Further, protrusion 40 is provided in the opposing inner sides of the supporting members 111 for restricting the counterclockwise rotations of the unit 10.

Between the supporting members 111, an elongated plate-like paper guide 14 and an elongated supporting plate 15 are disposed which extend in the direction parallel to the platen are supported to be rotatable about their base portions so that free edge portions of the paper guide 14 and the supporting plate 15 are moved toward and away from each other. On the axis about which the paper guide 14 is rotatable, an auxiliary guide roller 17 is rotatably supported. On the other hand, on the axis about which the supporting plate 15 is rotatable, a main guide roller 16 is rotatably supported. The guide roller 16 is rotated by a drive mechanism (to be described later). The main and the auxiliary guide rollers 16, 17 are in frictional contact with each other, and the print paper is discharged in the direction of the hopper frame 22.

Figure 17:
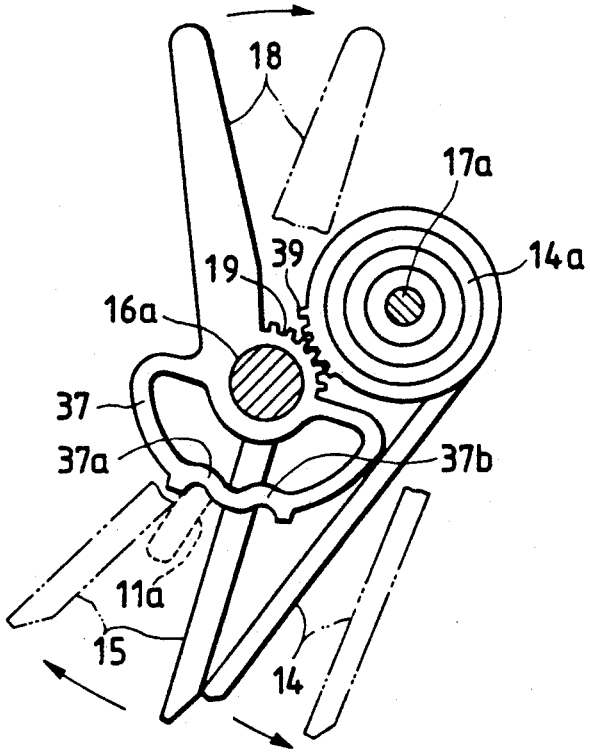
FIG. 17 is a vertical cross-sectional view showing a change-over mechanism of the sheet feed direction switching unit.

As shown in FIG. 17, an operation lever 18 made of a synthetic resin is provided in the edge portion of the supporting plate 15. In the base portion of the operation lever 18 and in the portion adjacent the shaft of the main guide roller 16, a gear portion 19 is formed and a locking member 37 having a semi-circular outer configuration is provided. In the locking member 37, two locking grooves 37*a* and 37*b* are formed which are separated by a predetermined distance. In the inner surface of one of the supporting members 11, a locking protrusion 11*a* is formed. In accordance with the operation of the lever 18, the locking grooves 37*a*, 37*b* are selectively brought to engagement with the locking protrusion 11*a*, thereby retaining the supporting plate 15 in the respective locking positions.

A disk-like support portion 14*a* is formed in one end of the paper guide 14 and in the portion adjacent the shaft 17*a* of the auxiliary guide roller 17. A gear portion 39 is formed in part of the outer periphery of the support portion 14*a*, which is meshingly engageable with the gear portion of the operation lever 18. Thus, the paper guide 14 is interlocked with the support plate 15. When the locking groove 37*a* is brought to engagement with the protrusion 11*a* by the operation of the lever 18, the free end portions of the paper guide 14 and the supporting plate 15 are moved toward each other through the meshing engagement in the gear portions 19, 39 and retained in a state where the free end portions thereof are in abutment with each other as indicated by the solid line in FIG. 17.

Figure 12B:
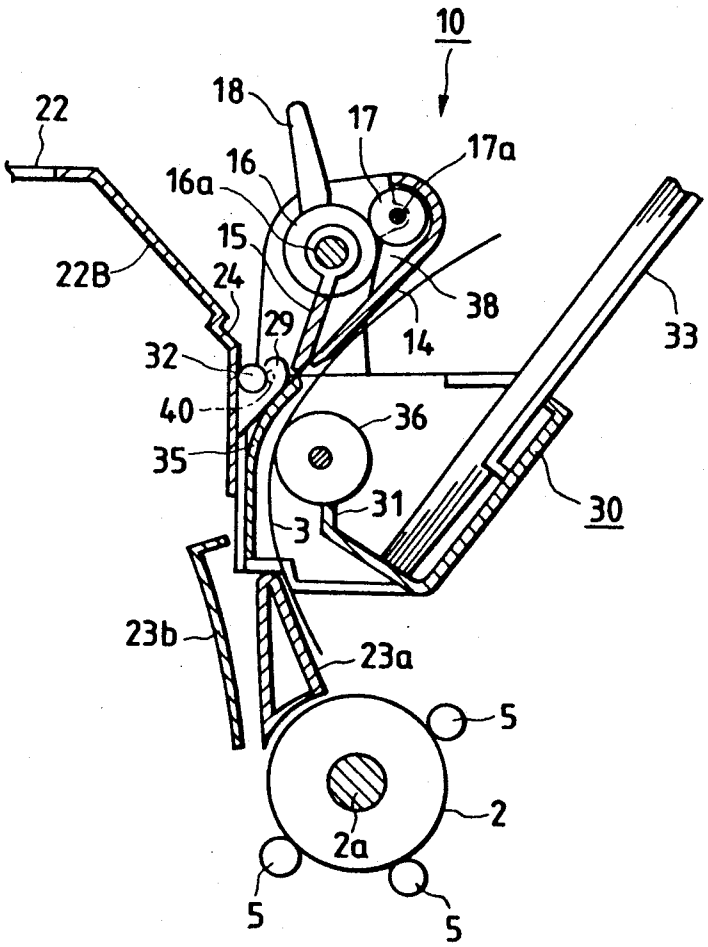
FIGS. 12A and 12B are vertical cross-sectional views showing the sheet feed direction switching unit when used for discharging the print sheet in face down.
Figure 12A:
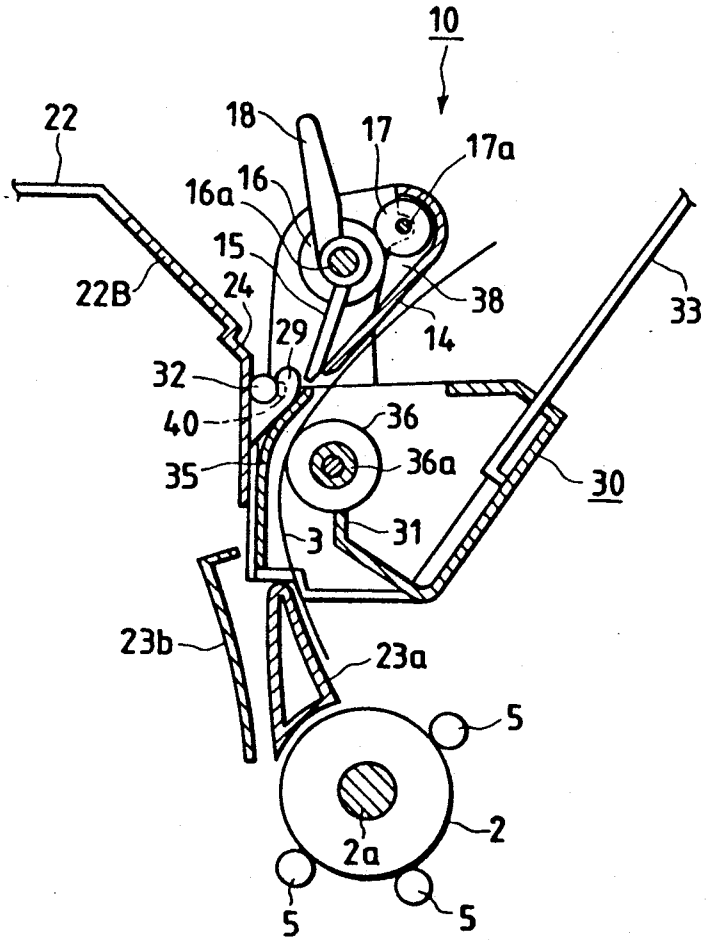

As shown in FIG. 12A, the paper guide 14 is arranged so that its outer surface is aligned with the guide wall 35. In the following description, this position of the paper guide 14 will be referred to as "the first guide position".

Figure 13B:
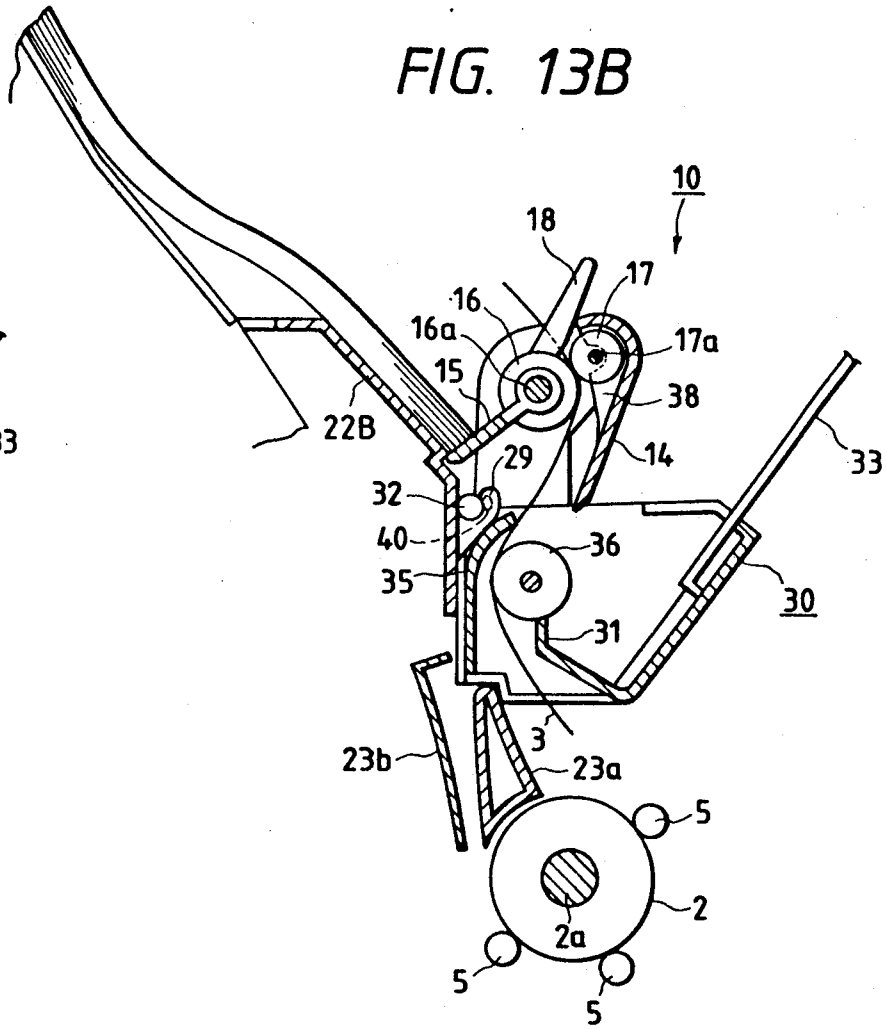
FIGS. 13A and 13B are vertical cross-sectional views showing the sheet feed direction switching unit when used for discharging the print sheet in face up.
Figure 13A:
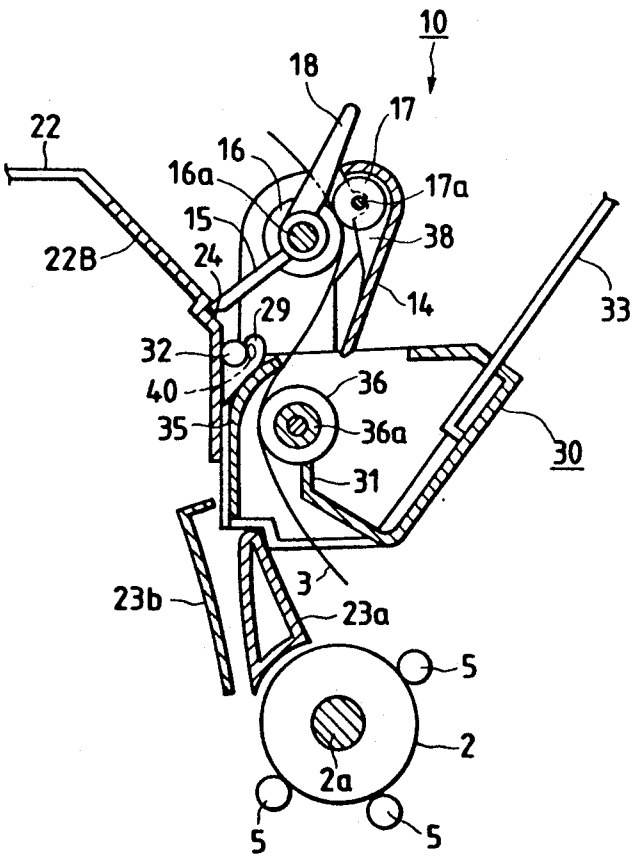
Figure 16:
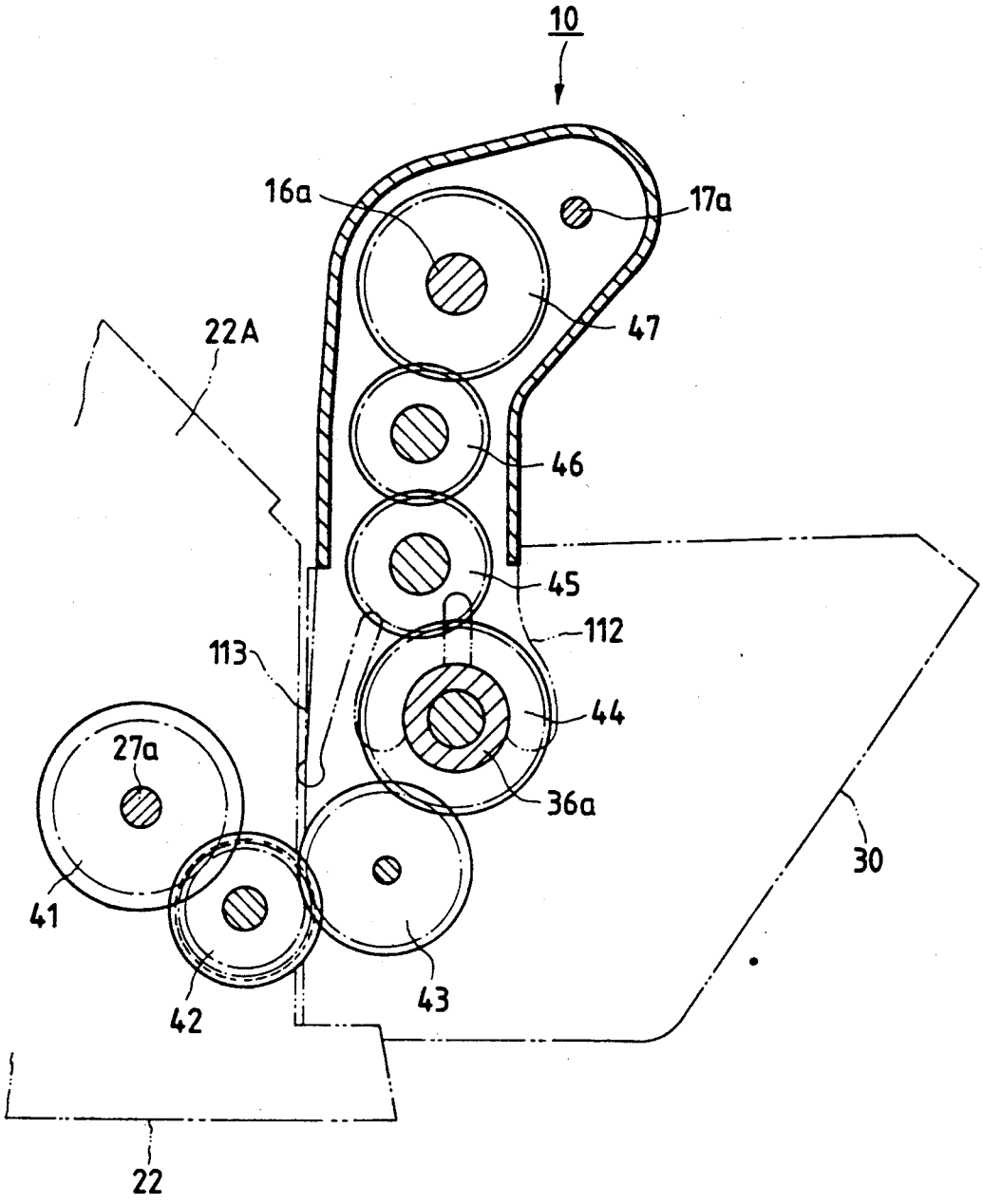
FIG. 16 is a vertical cross-sectional view showing a drive mechanism for the sheet feed direction switching unit.

On the other hand, when the operation lever 18 is rotated in the clockwise direction from the state indicated by the solid line in FIG. 16 to the state where the locking groove 37*b* is brought to engagement with the protrusion 11*a*, the paper guide 14 and the supporting plate 15 are held in spaced apart positions as indicated by two-dotted line in FIG. 17. As a result, the paper guide 14 is disposed to offset from the the guide wall 35 as shown in FIG. 13A. In the following description, this position of the paper guide 14 will be referred to as "the second guide position". At this time, the supporting plate 15 is brought to engagement with the recess portion 24 formed in the front wall plate 22*b*. The front wall plate 22B of the frame 22 is used as a sub-stacker adapted to receive the printed cut sheets one on the other. A multiplicity of guides are provided in the inner surface of the paper guide 14 for guiding the printed cut sheets delivered by the delivery roller 36 to enter into a nip between the main and auxiliary guide rollers 16, 17.

Next, description will be made with respect to the drive mechanism for driving the main guide roller 16.

As shown in FIG. 16, the main feed gear 41 is disposed outside the outer frame 22B of the hopper frame 22 and supported by the shaft 27*a* of the main feed roller 27 so that the main feed gear 41 is rotatable together with the main feed roller 27. The main feed gear 41 is driven by a drive mechanism (not shown). In the outside of the outer fame 22A and adjacent the main feed gear 41, two idle gears 42 having different diameters are provided to be rotatable together. A small-diameter gear is in meshing engagement with the the main feed gear 41.

On the other hand, a discharge gear 44 is disposed outside of the side frame of the stacker 30 and supported on the shaft 36*a* of the delivery roller 36 to be rotatable together with the delivery roller 36. In the outside of the stacker 30 and in the lower portion of the discharge gear 44, an idle gear 43 is rotatably supported which is in meshing engagement with both the large-diameter gear of the idle gear 42 and the discharge gear 44. When the stacker 30 is rotated counterclockwise about the rod piece 32, the idle gear 42 is disengaged from the idle gear 43.

Figure 18:
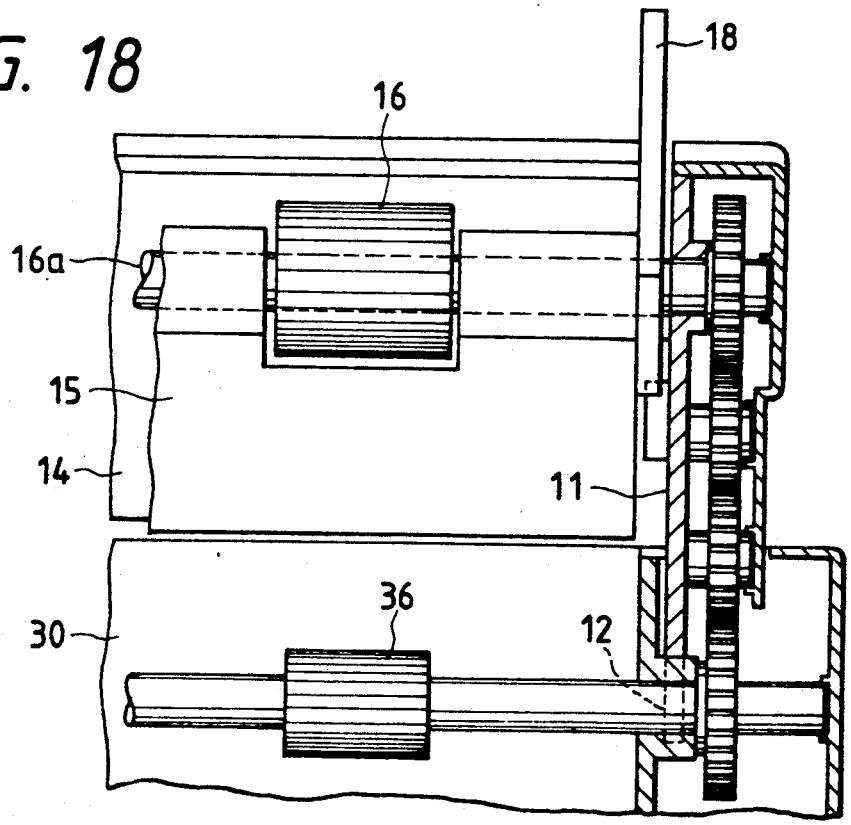
FIG. 18 is a plane view showing a main guide roller and a delivery roller.

In the supporting member 111 of the sheet discharge direction switching unit 10, an eject drive gear 47 is provided on the shaft 16*a* of the main guide roller 16 to be rotatable therewith. A pair of idle gears 45, 46 are rotatably supported in the supporting member 111 of the unit 10 in a position between the discharge gear 44 and the eject drive gear 47, so that the rotations of the discharge gear 44 is transmitted to the eject drive gear 47. In this manner, the eject drive gear 47 is operatively coupled to the main gear 41. In the meantime, FIG. 18 is a plan view showing the main guide roller 16 and the delivery roller 36 in relation to the drive mechanism as described.

In operation, when it is intended to discharge the print sheet 3 face down onto the stacker 3, the operation lever 18 is moved to the position shown in FIG. 12A. The paper guide 14 is placed in the first guide position where the free ends of the paper guide 14 and the support plate 15 are brought in abutment with each other and the paper guide 14 is brought in alignment with the guide wall 35. Thereafter, the feedout roller 26 is rotated by a motor (not shown) and the main feed roller 27 is rotated so that the uppermost sheet stacked in the hopper 25 is fed by the main and auxiliary feed rollers 27, 28 toward the platen 2 along the paper guide 23*b*. Upon printing on the sheet by the print head 6, the sheet 3 passes past the path defined by the guide wall 35 and the supporting portion 31 and then fed into a gap between the delivery roller 36 and the flexible film 34. By the rotation of the delivery roller 36, the sheet 3 is delivered toward the sheet feed direction switching unit 10. The sheet 3 is thereby directed toward the stacker 30 and discharged face down onto the stacker 30 as shown in FIG. 12B.

On the other hand, when it is intended to discharge the cut sheet face up, the operation lever 18 is operated so that the free ends of the paper guide 14 and the supporting plate 15 are spaced apart from each other as shown in FIG. 13A, thereby placing the paper guide 14 in the second guide position. Then, the paper guide 14 is rotated and the free end thereof is moved toward the supporting plate 33. As a result, an opening is formed between the upper portion of the guide wall 35 and the free end of the paper guide 14 allowing to receive the sheet 3. At this time, the free end of the supporting plate 15 is brought into engagement with the recess portion 24 of the front wall 22B. In this condition, after the leading edge of the cut sheet 3 delivered by the delivery roller 36 abuts the inner surface of the paper guide 14, it is guided by the guide portion 38, and then introduced into a nip between the main guide roller 16 and the auxiliary guide roller 17. Since the main and auxiliary guide rollers 16, 17 are interlockingly rotated with each other, the cut sheet 3 is discharged toward the front wall plate 22B in accordance with the rotations of the main and auxiliary feed rollers 16, 17. As a result, the printed cut sheet is discharged face up on the front wall plate 22*b* as shown in FIG. 13B. The supporting plate 15 supports the lower edges of the cut sheets placed on the front wall plate 22B to thereby prevent the sheets from slipped down along the plate 22B.

In the state shown in FIG. 12A, the gap between the guide wall 35 and the guide wall 35 of the stacker 30 is opened, and through this gap a cut sheet can be manually inserted toward the platen 2 through the path defined by the paper guides 23*a* and 23*b*.

As described, according to this embodiment, the printed cut sheets can be discharged face down on the stacker 30 by placing the paper guide 14 in the first guide position. On the other hand, by placing the paper guide 14 in the second guide position, the sheets can be discharged face up on the front wall plate 22B serving as a sub-stacker. In the case of discharging the cut sheets 3 onto the front wall plate 22*b*, the sheet are positively fed out by the main and auxiliary guide rollers 16, 17. Therefore, the cut sheets 3 are smoothly introduced into the sheet feed direction switching unit 10.

In this embodiment, since the sheet feed direction switching unit 10 is detachably mounted, it can be used only when it is necessary. The unit 10 is mounted adjacent the delivery roller 36, so that it does not bother recognition of the printed face of the cut sheets 3 discharged on the front wall plate 22B.

What is claimed is:

1. A sheet-feed/sheet receiving unit in combination with a printer having a print mechanism, the combination comprising a platen having an axis and being rotatable about its own axis for supporting a print sheet, and ink ribbon cassette accommodating an ink ribbon therein, and a print head movable along the platen for performing a print operation on the print sheet with the use of the ink ribbon, the printer being housed in a housing defined by a printer frame, a hopper frame disposed above a first area of the printer frame and having a pair of connection arms connected to the platen to be rotatable about the axis of the platen, said hopper frame being adapted to receive a hopper storing a stack of cut sheets therein and having feedout means for feeding an uppermost cut sheet toward the platen;

a stacker disposed above a second area of the printer frame, said stacker being rotatably coupled to said hopper frame about an axis substantially parallel to the axis of the platen and being movable between a cut sheet receiving position allowing to receive the cut sheets discharged from the platen and a stacker rest position, a space above the second area being enlarged when said stacker is brought to the stacker rest position; and a pin tractor disposed beneath the first area of the printer frame for mounting a continuous sheet, the continuous sheet being entrained by said pin tractor and fed toward the platen, wherein said hooper frame is movably disposed between a cut sheet feeding position and a hopper rest position, the cut sheet feeding position capable of feeding the uppermost sheet of the stack of cut sheets toward the platen, and in the hopper rest position, a space above the first area of the printer frame being enlarged for mounting the continuous sheet.

2. A unit according to claim 1, wherein a first cover is openably provided in the first area of the printer frame between an open position and closed position, the first cover being in a closed position when the hopper frame is in the cut sheet feeding position, and the first cover being in an open position for mounting the continuous sheet on said pin tractor when said hopper frame is brought to the hopper rest position.

3. A unit according to claim 2, wherein said first cover is pivotally movably hinged to the printer frame.

4. A unit according to claim 1, wherein the ink ribbon cassette is mounted in the second area.

5. A unit according to claim 4, wherein a second cover is openably provided in the second area of the printer frame allowing to exchange the ink ribbon cassette, said stacker being brought to the stacker rest position when said second cover is opened.

6. A unit according to claim 5, wherein said second cover is detachably provided on the printer frame.

7. A unit according to claim 1, further comprising a delivery roller for delivering the cut sheet discharged from the platen to said stacker.

8. A unit according to claim 7, further comprising a sub-stacker for receiving the cut sheet discharged from the platen, and a sheet feed direction switching unit detachably coupled to said stacker for switching a direction in which the cut sheet delivered from said delivery roller between a first direction and a second direction, wherein the cut sheet delivered by said delivery roller is discharged onto said stacker face down when the first direction is selected by said switching unit and the cut sheet delivered by said delivery roller is discharged onto said sub-stacker face up when the second direction is selected by said switching unit.

9. A sheet-feed/sheet-receiving unit in combination with a printer having a print mechanism, the combination comprising:

a platen having an axis and being rotatable about its own axis, an ink ribbon cassette accommodating an ink ribbon therein, a print head movable along the platen for selectively printing on a cut sheet and a continuous sheet with the use of the ink ribbon, the printer being housed in a housing defined by a printer frame, a hopper frame disposed above a first area of the printer frame, said hopper frame being adapted to receive a hopper storing a stack of cut sheets therein and having feedout means for feeding an uppermost cut sheet toward the platen;

a pin tractor disposed beneath the first area of the printer frame from mounting the continuous sheet, the continuous sheet being entrained by said pin tractor and fed toward the platen; and a stacker disposed above a second area of the printer frame, said stacker being rotatably coupled to said hopper frame about an axis substantially parallel to the axis of the platen and being movable between a cut sheet receiving position allowing to receive the cut sheets discharged from the platen and a rest position, said stacker having a supporting member for supporting the cut sheets delivered from the platen, and a sheet guide member, wherein when said stacker is brought to the cut sheet receiving position, cut sheet passageway is formed between the supporting member and the guide member for guiding the cut sheets discharged from the platen, and when said stacker is brought to the rest position, a continuous sheet passageway is formed between the guide member and said hopper frame for guiding the continuous sheet discharged from the platen, wherein said continuous sheet passageway extends in a direction substantially parallel to direction in which the continuous sheet discharged from said platen is fed.

10. A unit according to claim 9, wherein said hopper frame is movably disposed between a cut sheet feeding position and a hopper rest position, the cut sheet feeding position capable of feeding the uppermost sheet of the stack of cut sheets toward the platen, and in the hopper rest position, a space above the first area of the printer frame being enlarged for mounting the continuous sheet.

11. A unit according to claim 10, wherein said hopper frame has a pair of connection arms connected to the platen to be rotatable about the axis of the platen.

12. A unit according to claim 11, wherein a first cover is openably provided in the first area of the printer frame between an open position and closed position, the first cover being in a closed position when the hopper frame is in the cut sheet feeding position, and the first cover being in an open position for mounting the continuous sheet on said pin tractor when said hopper frame is brought to the hopper rest position.

13. A unit according to claim 12, wherein said first cover is pivotally movably hinged to the printer frame.

14. A unit according to claim 13, wherein the ink ribbon cassette is mounted in the second area.

15. A unit according to claim 14, wherein a second cover is openably provided in the second area of the printer frame allowing to exchange the ink ribbon cassette, said stacker being brought to the stacker position when said second cover is opened.

16. A unit according to claim 9, further comprising a delivery roller for delivering the cut sheet discharged from the platen to said stacker.

17. A unit according to claim 16, further comprising a sub-stacker for receiving the cut sheet discharged from the platen, and sheet feed direction switching unit detachably coupled to said stacker for switching a direction in which the cut sheet delivered from said delivery roller between a first direction, and a second direction, wherein the cut sheet delivered by said delivery roller is discharged onto said stacker face down when the first direction is selected by said switching unit and the cut sheet delivered by said delivery roller is discharged onto said sub-stacker face up when the second direction is selected by said switching unit.

18. A unit according to claim 16, further comprising a sub-stacker for receiving the cut sheet discharged from the platen, and a sheet feed direction switching unit rotatably coupled to said stacker for switching a direction in which the cut sheet delivered from said delivery roller between a first direction and a second direction, wherein the cut sheet delivered by said delivery roller is discharged onto said stacker face down when the first direction is selected by said switching unit and the cut sheet delivered by said delivery roller is discharged onto said sub-stacker face up when the second direction is selected by said switching unit, said switching unit being rotatable about another axis substantially parallel to the axis of the platen and being movable between a cut sheet receiving position allowing to receive and deliver the cut sheet toward either of the first and second directions and a reject position prohibiting to receive the cut sheet, said switching unit being brought to the reject position when said stacker is moved to the rest position.

19. A unit according to claim 9, wherein said stacker has an elongated box shape extending in a direction parallel to the axis of said platen, said stacker having a bottom plate formed with an opening through which the cut sheet passes, and wherein said sheet guide member is disposed in a position substantially in confrontation with said hopper frame, said sheet guide member serving to direct the cut sheet toward said stacker so as to be supported by said supporting member, whereby when said stacker is in the cut sheet receiving position, the cut sheet passes through the opening formed in the bottom plate of said stacker and is then guided by said sheet guide member so that the cut sheet is introduced into said stacker and supported by said supporting member.

20. A sheet-feed/sheet-receiving unit in combination with a printer having a print mechanism, the combination comprising a platen having an axis and being rotatable about its own axis for supporting a print sheet, an ink ribbon cassette accommodating an ink ribbon therein, and a print head movable along the platen for performing a print operation on the print sheet with the use of the ink ribbon, the printer being housed in a housing defined by a printer frame, a hopper frame disposed above a first area of the printer frame, said hopper frame being adapted to receive a hopper storing a stack of cut sheets therein and having feedout means for feeding an uppermost cut sheet toward the platen; and a stacker disposed above a second area of the printer frame and cover openably provided in the second area of the printer frame allowing to exchange the ink ribbon cassette, said stacker being rotatably coupled to said hopper frame about an axis substantially parallel to the axis of the platen and being movable between a cut sheet receiving position allowing to receive the cut sheets discharged from the platen and a stacker rest position, said stacker being brought to the stacker rest position when said cover is opened, a space above the second area being enlarged when said stacker is brought to the stacker rest position;

wherein the ink ribbon cassette is mounted in the second area.

21. A unit according to claim 20, further comprising a pin tractor disposed beneath the first area of the printer frame for mounting a continuous sheet, the continuous sheet being entrained by said pin tractor and fed toward the platen.

22. A unit according to claim 21, wherein said hopper frame is movably disposed between a cut sheet feeding position and a hopper rest position, the cut sheet feeding position capable of feeding the uppermost sheet of the stack of cut sheets toward the platen, and in the hopper rest position, a space above the first area of the printer frame being enlarged for mounting the continuous sheet.

23. A unit according to claim 22, wherein said hopper frame has a pair of connection arms connected to the platen to be rotatable about the axis of the platen.

24. A unit according to claim 22, wherein an additional cover is openably provided in the first area of the printer frame between an open position and a closed position, the additional cover being in a closed position when the hopper frame is in the cut sheet feeding position and the additional cover being in an open position for mounting the continuous sheet on said pin tractor when said hopper frame is brought to the hopper rest position.

25. A unit according to claim 24, wherein said additional cover is pivotally movably hinged to the printer frame.

26. A unit according to claim 20, wherein said cover is detachably provided on the printer frame.

27. A unit according to claim 20, further comprising a delivery roller for delivering the cut sheet discharged from the platen to said stacker.

28. A unit according to claim 27, further comprising a sub-stacker for receiving the cut sheet discharged from the platen, and a sheet feed direction switching unit detachably coupled to said stacker for switching a direction in which the cut sheet delivered from said delivery roller between a first direction and a second direction, wherein the cut sheet delivered by said delivery roller is discharged onto said stacker face down when the first direction is selected by said switching unit and the cut sheet delivered by said delivery roller is discharged onto said sub-stacker face up when the second direction is selected by said switching unit.

29. A sheet-feed/sheet-receiving unit in combination with a printer having a print mechanism, the combination comprising a platen having an axis and being rotatable about its own axis for supporting a print sheet, an ink ribbon cassette accommodating an ink ribbon therein, and a print head movable along the platen for performing print operation on the print sheet with the use of the ink ribbon, the printer being housed in a housing defined by a printer frame, a hopper frame disposed above a first area of the printer frame, said hopper frame being adapted to receive a hopper storing a stack of cut sheets therein and having feedout means for feeding an uppermost cut sheet toward the platen;

a stacker disposed above a second area of the printer frame, said stacker being rotatably coupled to said hopper frame about an axis substantially parallel to the axis of the platen and being movable between a cut sheet receiving position allowing to receive the cut sheets discharged from the platen and a stacker rest position, a space above the second area being enlarged when said stacker is brought to the stacker rest position;

a delivery roller for delivering the cut sheet discharged form the platen to said stacker;

a sub-stacker for receiving the cut sheet discharged from the platen; and a sheet feed direction switching unit detachably coupled to said stacker for switching a direction in which the cut sheet delivered from said delivery roller between a first direction and a second direction, wherein the cut sheet delivered by said delivery roller is discharged onto said stacker face down when the first direction is selected by said switching unit and the cut sheet delivered by said delivery roller is discharged onto said substacker face up when the second direction is selected by said switching unit.

30. A unit according to claim 29, further comprising a pin tractor disposed beneath the first area of the printer frame for mounting a continuous sheet, the continuous sheet being entrained by said pin tractor and fed toward the platen.

31. A unit according to claim 30, wherein said hopper frame is movably disposed between a cut sheet feeding position and hopper rest position, the cut sheet feeding position capable of feeding the uppermost sheet of the stack of cut sheets toward the platen, and in the hopper rest position, a space above the first area of the printer frame being enlarged for mounting the continuous sheet.

32. A unit according to claim 31, wherein said hopper frame has a pair of connection arms connected to the platen to be rotatable about the axis of the platen.

33. A unit according to claim 31, wherein a first cover is openably provided in the first area of the printer frame between an open position and a closed position, the first cover being in a closed position when the hopper frame is in the cut sheet feeding position, and the first cover being in an open position for mounting the continuous sheet on said pin tractor when said hopper frame is brought to the hopper rest position.

34. A unit according to claim 33, wherein said first cover is pivotally movably hinged to the printer frame.

35. A unit according to claim 29, wherein the ink ribbon cassette is mounted in the second area.

36. A unit according to claim 35, wherein a second cover is openably provided in the second area of the printer frame allowing to exchange the ink ribbon cassette, said stacker being brought to the stacker rest position when said second cover is opened.

37. A unit according to claim 36, wherein said second cover is detachably provided on the printer frame.

38. A unit according to claim 29, wherein said hopper frame includes a wall plate having a surface oriented in a direction substantially parallel to the second direction, and wherein said wall plate serves as said sub-stacker.

39. A unit according to claim 38, wherein said sheet feed direction switching unit includes a plate member pivotally movable between two positions in accordance with switching actions of said switching unit, said plate member being brought into enlargement with said wall plate when the second direction is selected by said switching unit and serving as a bottom plate of said sub-stacker for supporting the cut sheet.

* * * * *